United States Patent [19]

Gretter

[11] 3,992,844

[45] Nov. 23, 1976

[54] BUILDING PANEL

[76] Inventor: Joseph Clemens Gretter, 119 Seir Hill Road, Wilton, Conn. 06897

[22] Filed: Aug. 28, 1975

[21] Appl. No.: 608,658

[52] U.S. Cl. ..... 52/426; 52/564; 52/424; 52/562

[51] Int. Cl.[2] ..... E04B 2/00; E04B 1/02

[58] Field of Search ..... 52/612, 424, 562, 564, 52/565, 561, 426

[56] References Cited

UNITED STATES PATENTS

| | | | |
|---|---|---|---|
| 1,226,214 | 5/1917 | Hopkins | 52/426 |
| 1,312,309 | 8/1919 | Dietrichs | 52/564 |
| 1,345,156 | 6/1920 | Flynn | 52/426 |
| 1,810,891 | 6/1931 | Bemis | 52/426 |
| 1,962,514 | 6/1934 | MacWilliam | 52/564 |
| 2,465,687 | 3/1949 | Jacobsen | 52/424 |
| 2,669,861 | 2/1954 | Clutter | 52/426 |
| 2,938,376 | 5/1960 | Workman et al. | 52/426 |
| 3,353,315 | 11/1967 | Barker | 52/426 |

*Primary Examiner*—Price C. Faw, Jr.
*Assistant Examiner*—Robert C. Farber
*Attorney, Agent, or Firm*—Smythe & Moore

[57] ABSTRACT

A building panel comprises a rectangular substantially flat block of foam material having a plurality of parallel grooves in the inner face thereof. A plurality of similar panels are assembled in edge-to-edge relationship to form a wall and a spacer is received within the aligned grooves of a plurality of building panels. A second wall spaced from the first wall is formed of a similar plurality of panels and the spacer member is received within the opposed grooves of the inner faces of both walls so that a space is formed between the walls. Opposed blocks in the walls are clamped together to align the walls.

5 Claims, 7 Drawing Figures

BUILDING PANEL

The present invention relates to building panels of the type which are assembled in edge-to-edge relationship to form a wall structure and, more particularly, spacing and aligning of such panels.

In an attempt to simplify construction procedures and to decrease construction costs, various forms of building panels have been proposed. Such building panels are intended for assembly usually in edge-to-edge relationship to form a wall structure. Various structures have been proposed for retaining and securing the assembled panels in position so as to obtain an aligned wall structure of considerable strength. Such building panels have generally not come into widespread use because they are too complicated to assemble in order to form a structure having proper loadbearing capacity. Further, many of these building panels have been designed for particular materials, and a building panel structure suitable for one material would not be suitable for another material.

It has even been proposed to provide panels to be assembled into spaced walls with concrete or a similar substance being poured between the walls so that the walls provide, in effect, a form for the concrete. Upon hardening of the concrete, a unified structure is obtained of the spaced walls and the concrete together with the structure within the wall interconnecting the outer block walls. However, such proposals have been generally disadvantageous in that they did not provide sufficient load-bearing capacity or were too complicated or expensive in assembly.

One of the objects of the invention is to provide an improved building panel.

Another of the objects is to provide an improved wall structure formed from the building panels according to the present invention.

Another of the objects is to provide a building panel of a foam material which is simple in structure and can be readily assembled to form a wall structure.

According to one aspect of the present invention, the building panel for assembly with similar panels in edge-to-edge relationship to form a wall structure may comprise a rectangular substantially flat block of foam material having outer and inner faces and opposed substantially parallel side and top and bottom edges. There is a plurality of parallel grooves in the inner face of each panel parallel to the side edges to receive spacers therein. The spacers are separated and after assembly, the load-bearing concrete can be poured between the spacers which in conjunction with the walls form a mold. Also, the spacers can be chosen in length and depth to provide the desired configuration of wall structure.

The top and bottom edges of each panel can have upwardly sloping portions adjacent the outer face thereof to prevent the penetration of rain and moisture between the panels.

A wall structure formed from the building panels according to the present invention comprises outer and inner spaced walls, each being formed of a plurality of the building panels positioned in a plurality of horizontal rows in edge-to-edge relationship. An elongated, substantially vertically disposed spacer is positioned in the opposed grooves of the spaced walls. The horizontal edges of opposed panels are clamped together to align the walls and the space between the spaced walls may be filled with concrete.

Other objects, advantages and features of the invention will become apparent from the accompanying description and drawings, which are merely exemplary.

In the drawings.

Proceeding next to the drawings wherein like reference symbols indicate the same parts throughout the various views, a specific embodiment of the present invention will be described in detail.

Figure 1:
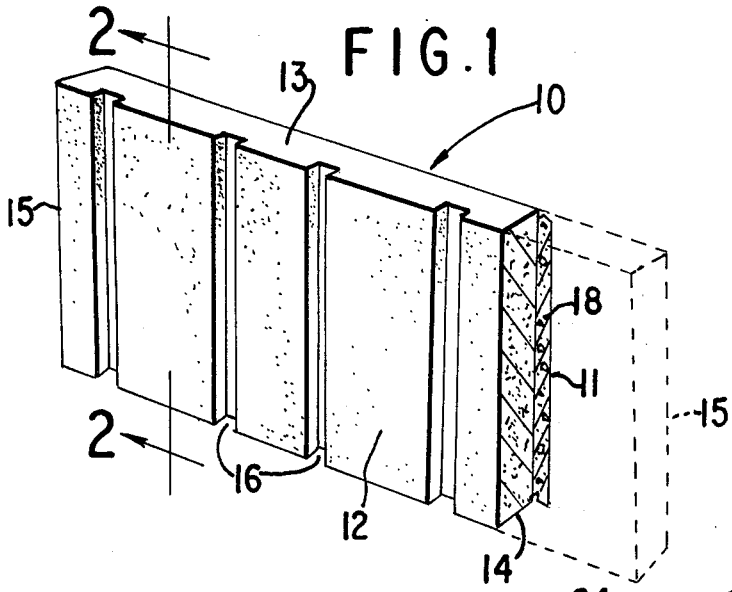
FIG. 1 is an overall perspective view looking at the inner face of a building panel according to the present invention with a portion thereof being cut away.

In FIG. 1, there is indicated generally at 10 a building panel according to the present invention and having an outer face 11, an inner face 12, a top edge 13, a bottom edge 14, and side walls 15. The panel 10 is in the shape of a rectangular, substantially flat block of preferably a light-weight foam cement or other foam material, such as plastics or glass. While such foam material generally has good insulating properties with respect to cold and heat, the relatively light structure of such foam materials decreases significantly the load-bearing capability of such a panel. However, the wall structure utilizing the panels according to the present invention will have sufficient load-bearing capacity for their purpose.

Figure 3:
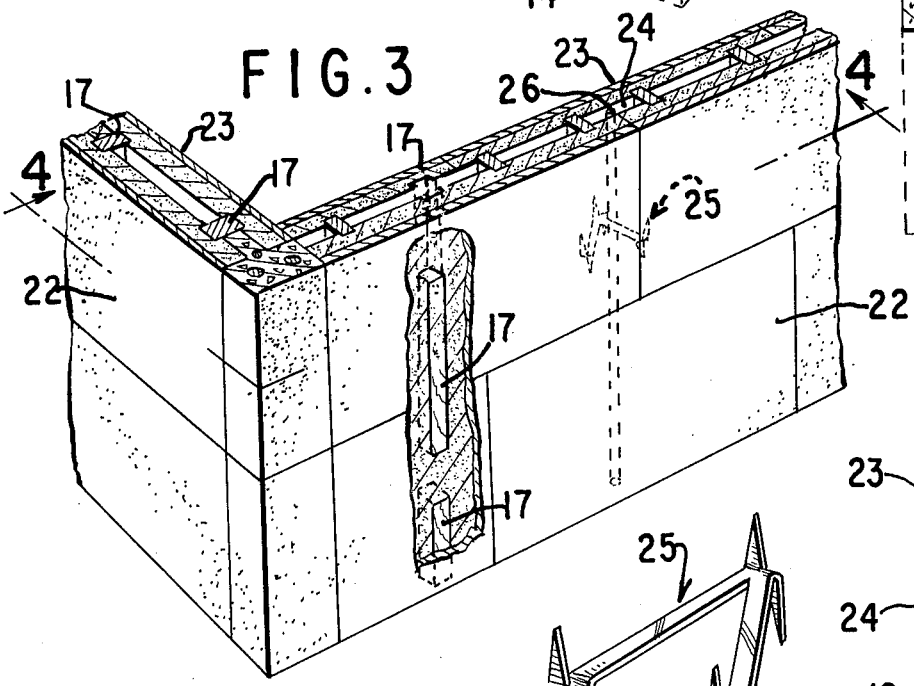
FIG. 3 is a perspective view of a portion of a wall structure incorporating the building panels according to the present invention.
Figure 5:
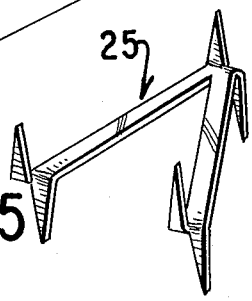
FIG. 5 is a perspective view of a pronged clamp used in the wall construction according to the present invention.

The inner face 12 of the building panel 10 is provided with a plurality of vertically extending grooves 16 having a substantially rectangular cross section so as to receive a correspondingly shaped spacer member 17 shown in FIG. 3.

According to the present invention, the panel may be made of a foam concrete, and the outer layer of the panel, indicated at 18, may be formed of a different material, such as concrete, which may be either sandwich cast with the foam in a form or can be applied or planted upon a precast foam blank as an architecturally designed composition.

Figure 2:
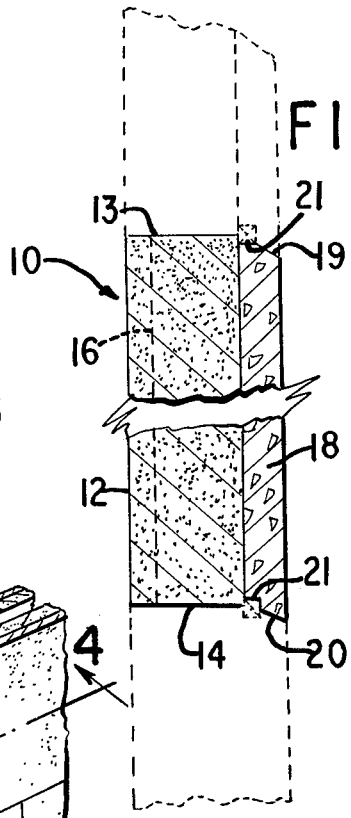
FIG. 2 is a sectional view taken along the line 2—2 of FIG. 1.

The upper edge 13 of the panel is provided with an upwardly sloping portion 19 (FIG. 2) adjacent the outer surface, and in a similar manner, the lower edge 14 is provided with a downwardly sloping portion 20. The fitting of the sloping portions with adjacent vertically positioned panels will prevent moisture or rain penetration in the space between the assembled panels.

A routed groove 21 is formed around the peripheral edges of the panel adjacent the sloping portions 19 and 20 in order to retain a caulking compound to waterproof the panel edges.

The panel 10 illustreated in FIG. 1 may be designated as a whole or full-length panel and the same panel may be cut in half to form a half panel for use in particular applications.

Figure 6:
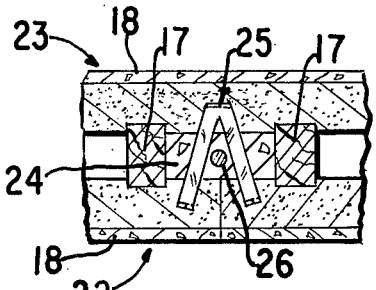
FIG. 6 is a portion in enlarged scale of FIG. 4 showing the relationship of the clamp in the wall.
Figure 4:
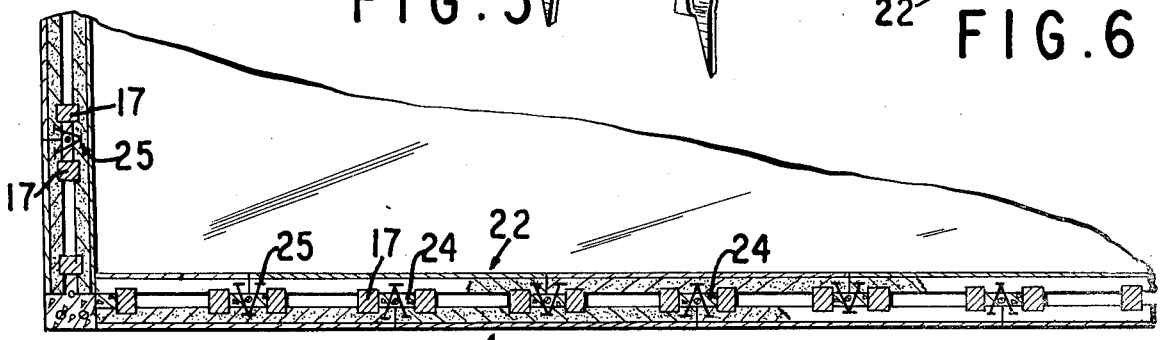
FIG. 4 is a sectional view taken along the line 4—4 of FIG. 3.
Figure 7:
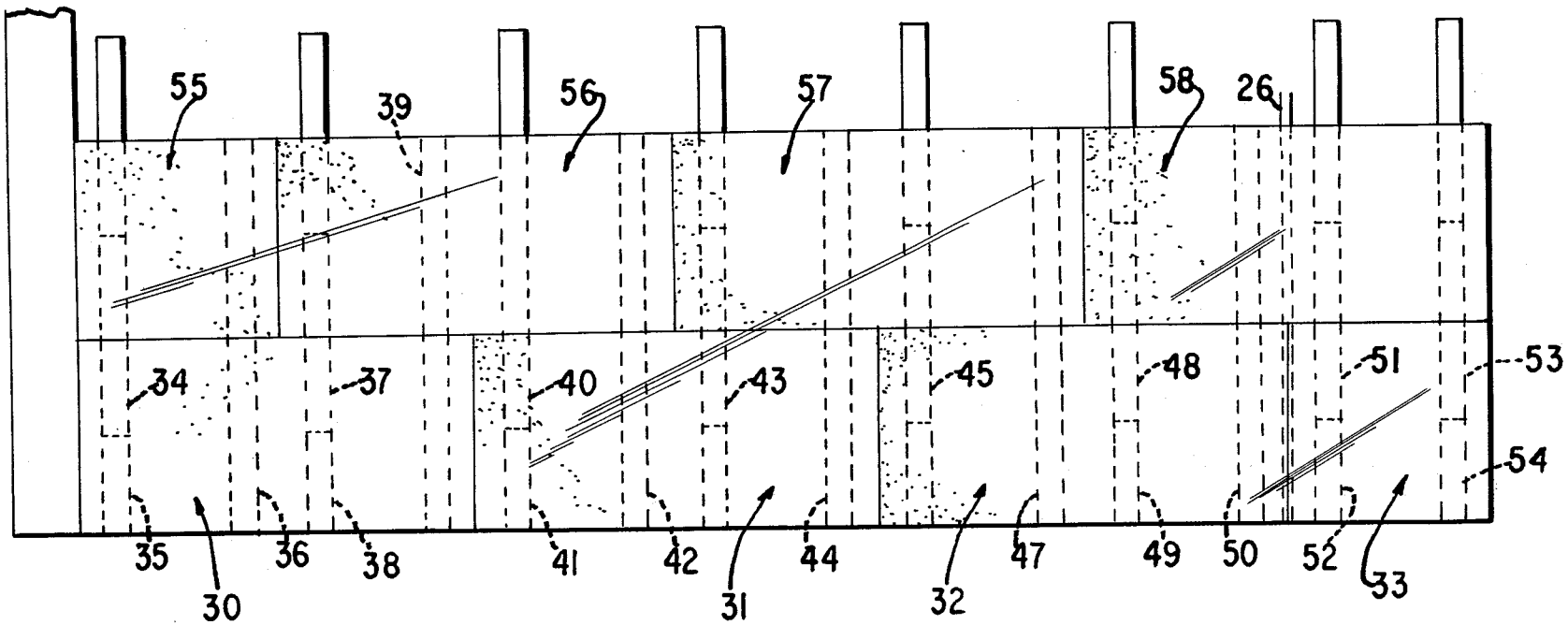
FIG. 7 is an elevational view of an assembled wall.

In order to construct a wall structure incorporating the building panels of the present invention, a plurality of panels are assembled in edge-to-edge relationship in a plurality of horizontal rows as shown in FIGS. 3 and 6 to form an outer wall 22 and an inner wall 23 spaced therefrom by a hollow area or void 24. A spacer member 17 is inserted in each pair of opposed grooves in the inner and outer walls to obtain the structure as shown in FIGS. 3 and 4. The spacer members are shown in greater detail in FIGS. 6 and 7.

The depths of the grooves 16 and spacers 17 may be varied so as to provide variations of the distance 24 between the inner and outer walls. In other words, the spacers can be increased in thickness to provide preselected void width. Also, the grooves can be varied in depth to cooperate with the spacer to provide desired void widths.

A three-point staple clamp indicated generally at 25 in FIG. 4 is hammered into the tops of opposed assembled panels in the manner as shown in FIG. 6 to retain the assembled panels in alignment and to position a reinforcement rod 26 which is inserted vertically in the wall between the legs of the clamp. Reinforcement rod 26 also can be vibrated so as to assist the concrete to flow.

The space 24 between the walls is then filled with concrete and the clamps 25 become part of the concrete structure. The material poured into space 24 serves as the load-bearing member. The result is a load-bearing capability that will greatly exceed the stress and shock resistant capabilities of present ordinary block and mortar construction. The walls 22 and 23 together with the concrete therebetween form a unified structure.

The voids between the walls 22 and 23 and the spacer member 17 may be varied in both dimension and size in order to fit certain specified needs without changing the basic concept of the present invention.

The spacer members 17 may be cast or formed out of the same foam material as the panel 10.

According to the present invention, the grooves 16 on the back of a building panel 10 may be omitted when the panels are to be used for surfacing over an old wall or over regular studding or a frame. A fastening device as known in the art may be used to clamp the foam cement backing of the panels into position.

The concrete poured into the spaces formed between the walls of building panels may be provided with suitably sized aggregate and may be settled in the bottom portions of the voids by the use of vibration means as known in the art.

Bottom panels 30, 31, 32, 33 can be erected and spaced from corresponding rear panels by spacers 34 to 52. The second tier of panels 55 to 58 then can be erected on top of the lower tier of panels.

One set of spacers will be described. Spacer 35 is one half the length of spacer 34 so that spacer 34 extends upwardly into panel 55, thus serving to position the panels relative to each other. Spacer 36 only extends the height of panel 30. Spacers 37 and 38 repeat the lengths of spacers 34 and 35 so as to hold the panels in desired position. Panel 55 is one-half the length of panel 30 so that the joints are staggered. When the top course or tier is reached, the top spacer is made one half.

Thus, it can be seen that the present invention has disclosed a novel building panel which can be employed to form a wall structure which has proper load-bearing capabilities and which can be quickly assembled.

It will be understood that changes in various details of construction and arrangement of parts may be made without departing from the spirit of the invention except as defined in the appended claims.

What is claimed is:

1. A wall structure comprising a plurality of rectangular substantially flat blocks positioned in a plurality of horizontal rows in edge-to-edge relationship to form an outer wall, a second plurality of rectangular substantially flat blocks positioned in a plurality of horizontal rows in edge-to-edge relationship to form an inner wall spaced from said outer wall, the inner faces of said blocks each having a plurality of vertically extending grooves therein such that the grooves of the several rows of blocks are aligned, an elongated spacer member vertically positioned in one pair of opposed rows in each block of said inner and outer walls and extending from top to bottom thereof, and elongated spacer members of varying lengths are positioned in abutting relationship in another pair of opposed rows in each block whereby the uppermost of said last mentioned spacer members extend upwardly into alternate grooves in a block of a row thereabove, and means interposed between said spacer members and straddling and embedded in vertically abutting blocks of each row for clamping horizontal edges of opposed blocks in said inner and outer walls to align the panels in position.

2. A wall structure as claimed in claim 1 wherein said spacer has a rectangular cross section.

3. A wall structure as claimed in claim 2 wherein said grooves each have a cross section corresponding to the cross section of the spacer member.

4. A wall structure as claimed in claim 1 and further comprising a clamp having upwardly and downwardly extending three-point prongs.

5. A wall structure as claimed in claim 1 wherein the space between said inner and outer walls is filled with concrete to form a unified reinforced concrete upright having greater load-bearing capacity.

* * * * *